US006239676B1

(12) United States Patent
Maloney et al.

(10) Patent No.: US 6,239,676 B1
(45) Date of Patent: May 29, 2001

(54) TWO POLE CIRCUIT BREAKER CALIBRATED IN ASSEMBLED STATE

(75) Inventors: James Gerard Maloney, Industry, PA (US); Miguel Angel Gonzales, Lares, PR (US); Ronald Dale Smiddle, Canonsburg, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/649,364

(22) Filed: Aug. 28, 2000

(51) Int. Cl.[7] ..... H01H 75/08; H01H 77/04; H01H 81/02

(52) U.S. Cl. ..... 335/6; 335/35; 335/43; 335/45

(58) Field of Search ..... 335/6, 8, 9, 10, 335/35, 42, 43, 44, 45

*Primary Examiner*—Ramon M. Barrera
(74) *Attorney, Agent, or Firm*—Martin J. Moran

(57) ABSTRACT

A two-pole miniature circuit breaker is configured for calibration of both pole mechanisms with the circuit breaker fully assembled. The identical pole mechanisms are mounted in the same orientation in parallel outer compartments of a molded housing with the metal support frame of one pole against the outer housing wall and the frame of the other spaced from the associated outer wall. A coupler couples the two-pole mechanisms together for simultaneous opening of both poles when either pole is tripped has an actuating member on each end which engages the trip device of the associated pole. The actuating member, at least of the pole with the metal frame spaced from the housing outer wall, is configured to provide direct access for a calibration tool inserted through a calibration opening in the housing to engage a calibration slot in the metal frame.

2 Claims, 4 Drawing Sheets

FIG. 6
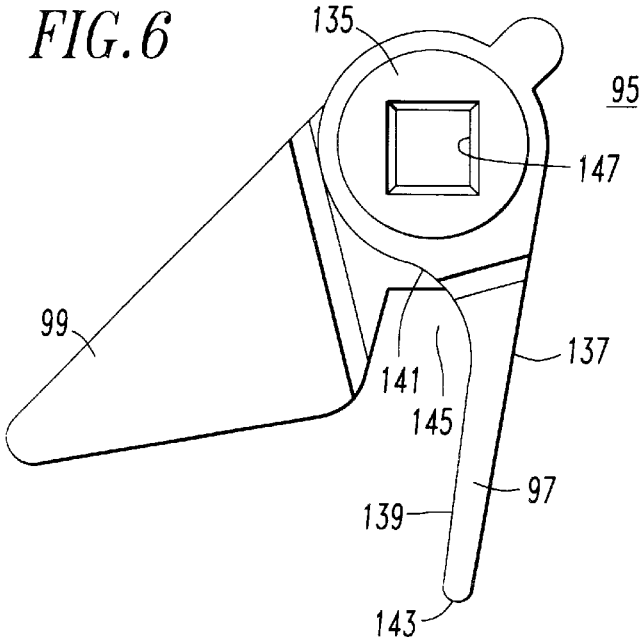
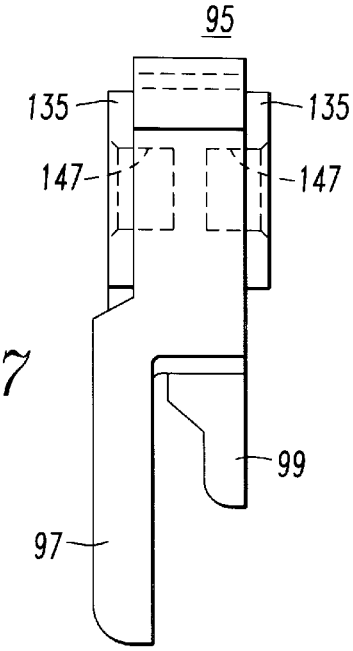
FIG. 7
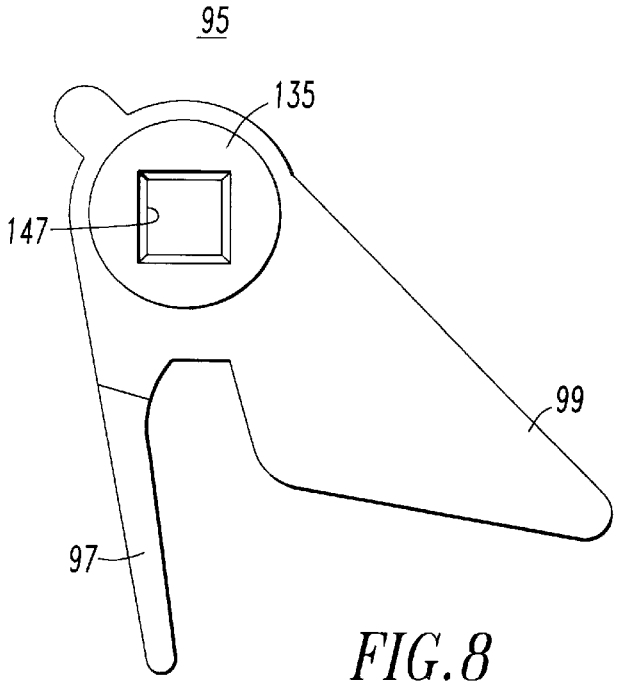
FIG. 8

TWO POLE CIRCUIT BREAKER CALIBRATED IN ASSEMBLED STATE

BACKGROUND OF THE INVENTION

1. Field of the Invention

This invention relates generally to circuit breakers, and particularly to a two-pole miniature circuit breaker provided with an arrangement for calibrating the delayed trip function with the circuit breaker fully assembled.

2. Background Information

Circuit breakers designed for residential and light commercial applications are typically referred to as miniature circuit breakers. Such circuit breakers have pole mechanisms which include separable contacts, a spring powered operating mechanism with a handle for manual opening and closing of the separable contacts and a trip assembly for automatically opening the separable contacts. The trip assembly includes a bimetal providing a thermal or delayed trip in response to a persistent overcurrent condition, and a magnetic armature providing a magnetic or instantaneous trip in response to a higher level overcurrent. The pole mechanism is mounted in a housing molding of an insulative resin and having a compartment in which the pole mechanism is assembled. A molded cover is then secured in place to enclose the pole mechanism.

Industry standards require that the thermal trip device in these circuit breakers be calibrated to trip the breaker in response to an overcurrent of a predetermined magnitude within a specified time interval. Traditionally, this calibration of the thermal trip is performed "on the half shell". That is, the pole mechanism is assembled within the compartment of the molded housing, and the thermal trip is calibrated before the mechanism is enclosed by the cover.

A common type of circuit breaker in which the thermal trip is calibrated in this manner is shown by way of example in U.S. Pat. No. 3,849,747. Such circuit breakers have been used for many years and their design has been refined to provide an effective, reliable circuit breaker which can be easily and economically manufactured on a large scale. This type of circuit breaker has a metal frame or support plate with an integral tab extending laterally from one end to which the bimetal of the thermal trip device is secured. The end of the support plate from which the tab extends is partially separated by a transverse slot from the remainder of the support plate which is fixed in the housing. The bimetal is calibrated by closing the circuit breaker and applying the prescribed overcurrent. A tool is inserted in the transverse slot in the support plate and when a specified time has expired, the tool is rotated to distort the free end of the support plate thereby adjusting the position of the support for the bimetal to cause the bimetal to trip the breaker. This calibration has traditionally been carried out automatically, "on the half shell" by a machine. With the calibration set, the cover is installed and riveted in place. The circuit breaker is then tested to validate the calibration. Circuit breakers which do not pass the calibration test are reworked by inserting a hook through a slot in the end of the circuit breaker to engage the free end of the bimetal to attempt to bring it within tolerance. Such reworking is done manually, and being difficult to perform only results in bringing about half of the rejected circuit breakers into tolerance.

It has been determined that the number of circuit breakers which fail the calibration test performed after the cover has been installed is due in part to minor changes in position and distortion of the mechanism resulting from the misalignment of the housing parts causing the breaker to fall out of calibration. In order to overcome these effects, U.S. Pat. No. 4,148,004 proposes a single pole circuit breaker of this type which is fully assembled with the cover riveted in place, and then calibrated by a plug rotatably mounted in the wall of the housing and having a bifurcated stem which engages the tab on the support plate carrying the fixed end of the bimetal. A tool inserted in apertures in the external face of the calibrating plug is rotated to set the calibration. Thus, the circuit breaker is calibrated after it is fully assembled and the parts are fixed in their final position. However, it also allows one to change the calibration which is not in conformance with electrical codes in the United States.

U.S. Pat. No. 5,008,645 discloses a single pole miniature circuit breaker which can be calibrated after full assembly and which provides an indication of any subsequent tampering with that calibration. This patent provides an opening in the housing which is aligned with the slot at the interface between the fixed portion of the metal support frame and the free end to which the bimetal is fixed. The automatic tool is inserted through this opening in the housing and rotated to bend the free end of the support plate relative to the fixed end to thereby adjust the trip point of the bimetal. The calibration is made tamper evident by applying a seal over the calibration opening once the thermal trip has been calibrated.

Both the U.S. Pat. Nos. 4,148,004 and 5,008,645 are directed to single pole miniature circuit breakers. Two-pole miniature circuit breakers are also available. These circuit breakers have identical pole mechanisms housed in side-by-side compartments within the molded housing. Such circuit breakers are commonly used in circuits where both pole mechanisms must be either open or closed. Thus, the handles are tied together so that the two poles are simultaneously opened and closed manually. A common trip device assures that when one pole mechanism trips, the other is tripped also. The common trip device includes actuating members in each pole compartment keyed on a common shaft so that when one actuating member is rotated the other is rotated also. The actuating members include a nose which is engaged by the tripping of a pole mechanism. Each of the actuating members also includes a finger which engages and trips the magnetic actuator of the associated pole when the common trip device is rotated. Thus, when either pole mechanism trips, either thermally or magnetically, the other pole is also tripped.

The metal support plate of one the poles of the two-pole miniature circuit breaker is adjacent to the outer wall of the associated pole compartment, and therefore, can be calibrated in the assembled state in the same manner as the single pole breaker of U.S. Pat. No. 5,008,645. That is, the tool can be inserted through an opening in the housing wall in direct alignment with the calibration slot in the metal support plate. However, since the two-pole mechanisms are identical, the metal support plate of the other pole is not adjacent an outer wall of the housing, but is separated from it by the remainder of the pole mechanism. More of a problem however, is that the actuating member of the common trip device interferes with the insertion of a calibrating tool into the calibration slot of this pole mechanism when the two-pole breaker is assembled. Thus, heretofore it has not been possible to calibrate the two-pole miniature circuit breaker while fully assembled. Consequently, the two-pole circuit breakers have continued to be calibrated "on the half shell" with all of the attendant problems discussed above, which are compounded by the need to achieve proper calibration of both poles.

There is a need therefor for an improved two-pole circuit breaker which can be calibrated when fully assembled.

SUMMARY OF THE INVENTION

This need and others are satisfied by the invention which is directed to a two-pole circuit breaker which can be calibrated when fully assembled. The circuit breaker comprises two pole mechanisms each having a bimetal and a metal frame on which the bimetal is mounted. The bimetal has a calibration opening in which a tool may be inserted to effect the calibration of the bimetal. The two-pole circuit breaker also includes a molded housing having two side-by-side outer compartments, each housing one of the pole mechanisms. The housing has calibration holes in sidewalls of the two outer compartments each of which is aligned with the calibration receptacle of the associated pole mechanism. The circuit breaker further includes a coupling member comprising a rod extending between the two outer compartments adjacent the calibration receptacles. The coupling member includes actuating members on opposite ends of the rod each engaging an associated one of the two pole mechanisms for simultaneous opening of both pole mechanisms. One of the actuating members associated with one of the poles is axially positioned on the rod between the calibration hole in the housing and the calibration receptacle in the associated frame. This actuating member has an actuating finger configured to permit direct, unobstructed access through the calibration hole to the calibration receptacle by the calibration tool with the breaker fully assembled. The least the one actuating member has a nose which is engaged by the associated pole mechanism when it is tripped to rotate the coupler. This actuating member also has a hub mounted on the rod and from which the nose and the finger extend. The nose and finger of the actuating member form a gap which is configured to permit the unobstructed, direct access to the associated calibration receptacle through the calibration opening even with rotation of the actuating member by engagement of the nose by the pole mechanism.

Each pole mechanism has a trip device, comprising a bimetal and a magnetic armature, which when actuated trips the pole mechanism open. The finger on the associated actuating member has a free end engaging the magnetic armature to actuate the trip device as the actuator is rotated. The finger is tapered toward the free end to distribute the load produced by engagement with the magnetic armature to preclude failure of the actuating member. The tapered actuating finger is substantially tangent to the hub of the actuating member on one face of the finger and has an arcuate interface with the hub on the opposite face. The calibration receptacle can be a slot in the metal frame of the pole mechanism. To this end, the metal frame has a fixed portion secured to the housing and a free section to which the bimetal is secured. The calibration receptacle is a slot at the interface between a fixed portion and the free section of the metal frame in which the calibration tool is manipulated to bend the free section of the frame relative to the fixed section.

BRIEF DESCRIPTION OF THE DRAWINGS

A full understanding of the invention can be gained from the following description of the preferred embodiments when read in conjunction with the accompanying drawings in which:

FIG. 6 is a side elevation view of an actuating member which forms part of the circuit breaker of FIG. 3.

FIG. 7 is an elevation view of the opposite side of the actuating member of FIG. 6.

FIG. 8 is an end view of the actuating member of FIGS. 6 and 7.

DESCRIPTION OF THE PREFERRED EMBODIMENTS

The invention will be described as implemented in a two-pole ground fault circuit breaker; however, it will become apparent seen that the invention is also applicable to two-pole circuit breakers with/without ground fault protection or other electronic protection such as arc fault protection.

Figure 1:
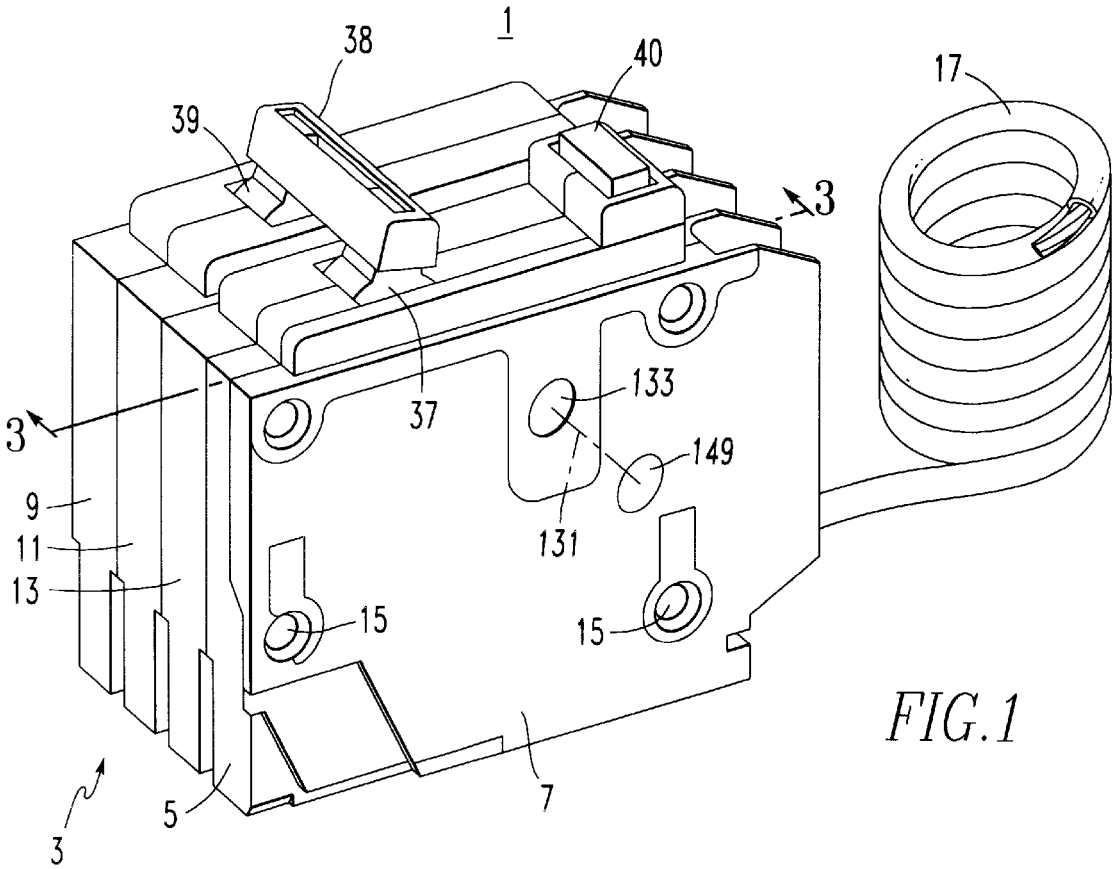
FIG. 1 is an isometric view of a two-pole, ground fault circuit breaker incorporating the invention.

Referring to FIG. 1, the two-pole ground fault circuit breaker 1 has a housing 3 which is molded in sections from an electrically insulative resin. The sections of the housing include a top base 5, a top cover 7, a bottom cover 9, a bottom base 11 and a hollow centerbore 13, all secured together such as by rivets 15. A pigtail 17 connects a neutral conductor within the circuit breaker to a neutral bar (not shown) in a load center in which the circuit breaker 1 may be mounted.

Figure 2:
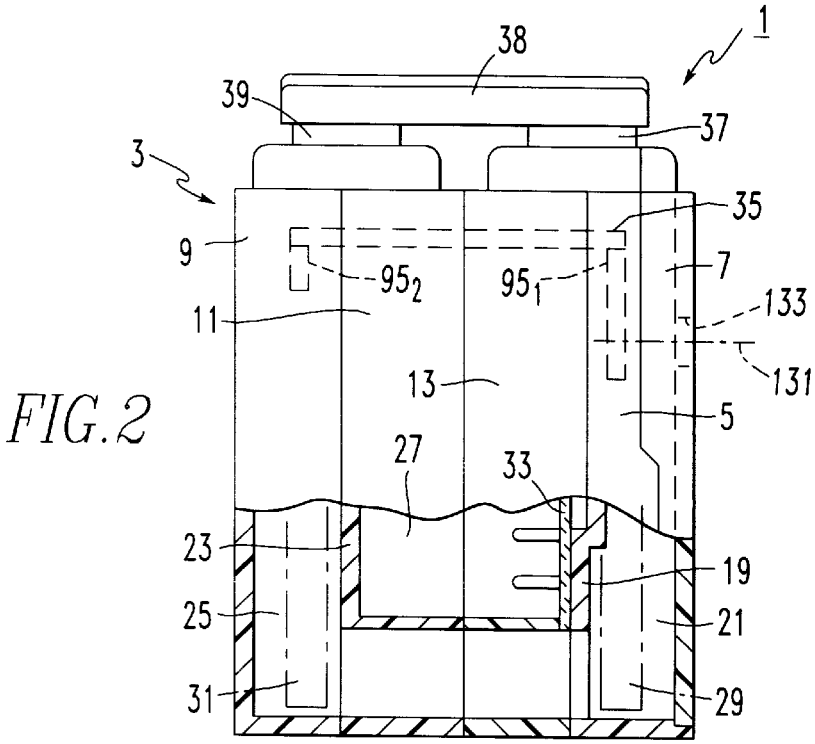
FIG. 2 is an end view of the circuit breaker of FIG. 1 with parts broken away and with some parts shown schematically.

Turning to FIG. 2, the top base 5 forms a partition 19 which forms where the top cover a first compartment 21. The bottom base 11 similarly has a partition 23 which forms with the bottom cover 9 a second compartment 25. The partition 19 of the top base 5 and the partition 23 of the bottom base 11, together with the hollow center base 13 form a third compartment 27 between the first and second compartments. The three compartments 21, 23 and 27 extend side-by-side. The two outer compartments 21 and 25 are pole compartments in which pole mechanism 29 and 31 (shown schematically in FIG. 2) are supported on the partitions 19 and 23, respectively, in a manner to be described. The third or middle compartment 27 houses the electronics 33 (shown schematically) which provide the ground fault protection. If desired, the electronics 33 may also, or in the alternative, provide arc fault protection. A coupler 35 (also shown schematically) extends between the first and second compartments 21 and 25 to interconnect the pole mechanisms 29, 31 in a manner to be discussed.

Referring to both FIGS. 1 and 2, each of the pole mechanism 29 and 31 had a handle 37 and 39, respectively, which projects through the top of the housing 3 and is joined to the other by a handle tie 38. As also shown in FIG. 1, a test button 40 is provided for testing the electronics 33.

Figure 3:
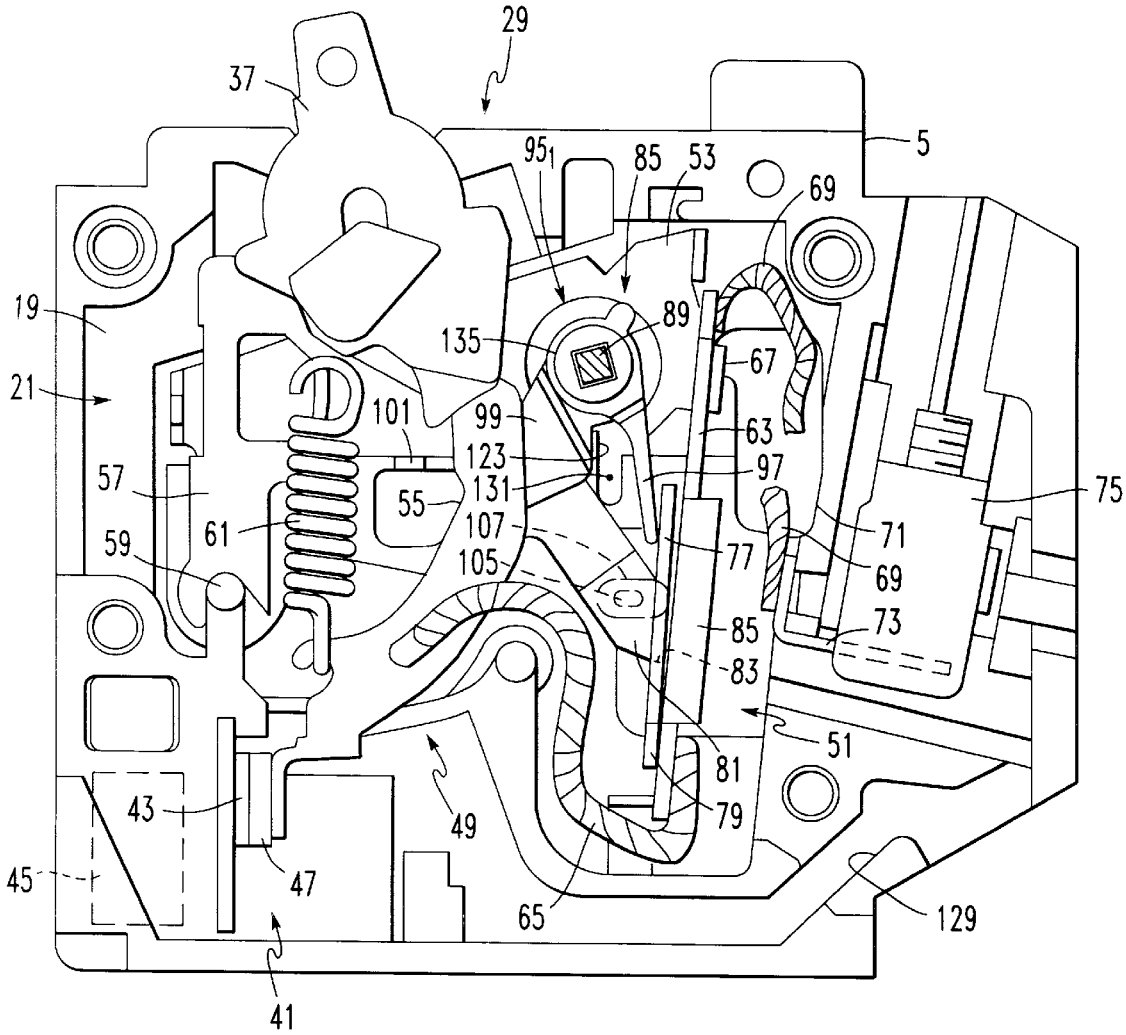
FIG. 3 is a vertical sectional view taken along the line 3—3 in FIG. 1 of one of the mechanical poles shown in the closed position.

As the pole mechanisms 29 and 31 are identical, only the first pole mechanism 29 mounted in the first pole compartment 21 will be described. As can be seen in FIG. 3, the pole mechanism 29 has a set of separable contacts 41 including a fixed contact 43 connected to a line terminal 45 and a movable contact 47. Pole mechanism 29 further includes an operating mechanism 49, a thermal magnetic trip device 51 and a supporting metal frame 53.

Briefly, the operating mechanism 49 includes a contact arm 55 carrying the moveable contact 47 at a lower end a cradle 57 pivoted about a pivot pin 59 molded in the partition 19 of the top base 5. The contact arm 55 is connected to the cradle 57 by a helical tension spring 61. The upper end of the contact arm 55 is engaged by the molded handle 37. Movement of the handle 37 in the counterclockwise direction to the position shown in FIG. 3 rotates the contacts arm 55 to close the separable contact 41 as is well known. When the handle 37 is moved clockwise in FIG. 3 to the off position (not shown), the contact arm 55 moves away from the fixed contact 43 to open a separable contacts 41, as is well known.

The contact arm 55 is electrically connected to the lower end of elongated bimetal element 63 by flexible conductor 65. The bimetal 63 is part of the thermal-magnetic trip device 51 and is secured at its upper end to a flange 67 on the metal frame 53. Another flexible conductor 69 connected to the upper end of the bimetal 63 passes through an opening 71 in the partition 19 into the third compartment 27 where it is connected to the ground fault electronics, and returns through the opening 71 and is connected to a tang 73 engaging a load connector 75. Thus, with the separable contacts 41 closed as shown in FIG. 3, a closed circuit through the pole 29 extends from the line terminal 45 through the fixed contact 43, the moveable contact 47 the contact arm 55, the flexible conductor 65, the bimetal 63, the flexible conductor 69, the tang 73 and load conductor 75.

The thermal-magnetic trip device 51 includes in addition to the bimetal 63, an elongated rigid magnetic armature or latch member 77 secured to the lower end of the bimetal 63 by flexible metal strip 79, and a finger 81 on the cradle 57. The magnetic armature 77 has an opening 83 which defines a latch surface on which the finger 81 of the cradle 57 is latched when the mechanical pole is reset by moving the handle slightly past the off position, as is well-known.

When the circuit breaker 1 is in the on position, as shown in FIG. 3, and a overload current above a first predetermined value persists, the bimetal 63 is heated by the current flowing through it which deflects the lower end counterclockwise to unlatch the finger 81 from the latch opening 83. This releases the cradle 57 which allows the spring 61 to rotate the contact arm 55 counterclockwise as viewed in FIG. 3 to a tripped position (not shown) in which the separable contacts 41 open. When a short circuit occurs with the circuit breaker in the on position shown in FIG. 3, the current generates a magnetic field which is channeled by a U-shaped pole piece 85 mounted on the bimetal 63 to attract the magnetic armature 77 toward the pole piece to unlatch the cradle 57 and thereby trip the separable contacts open.

As previously discussed in connection with FIG. 2, a coupler 35 couples the two pole mechanisms 29 and 31 together so that when one mechanical pole trips, the other pole trips simultaneously. This coupler 35 includes a coupling rod or shaft 89 extending through the third compartment 27, the partition 19 into the first compartment 21 and partition 23 the second compartment 25. On each end of the rod 89 is an actuating member $\mathbf{95}_1$ and $\mathbf{95}_2$, respectively, for engaging the associated pole mechanism 29, 31. Each actuating member has an actuating finger 97 adjacent to the magnetic armature 77 of the associated pole. Each actuating member also has a nose 99 disposed adjacent a flange 101 on the cradle 57 of the associated pole mechanism. When one of the poles of the circuit breaker trips, the associated cradle 57 engages the nose 99 and rotates the coupling rod 89. This in turn rotates the actuating member 95 on the other end of the rod 89 so that the actuating finger 97 of that actuating member engages the associated magnetic armature 77 to unlatch the cradle 57 and trip the other pole.

The bimetals 63 of the respective poles are designed to respond to low level overcurrents inversely as a function of time. That is, the greater the magnitude of the current the shorter the time for the thermal trip. While the construction of the bimetals is such that they conform to the overcurrent characteristic reliability, the circuit breaker 1 must be calibrated to assure that this inverse current response characteristic produces a trip at code specified conditions. For example, the circuit breaker can be calibrated so that at 250% of rated current a pole trips within 15 to 25 seconds. The circuit breaker 1 is calibrated by applying the specified overcurrent to a pole, and then adjusting the mechanism so that it trips within the specified time period. Thus, for example, in a case of a twenty amp circuit breaker, each pole is separately calibrated by applying 50 amperes to the pole in the closed position, and the mechanism is adjusted so that a trip occurs within 15 to 25 seconds.

In addition to the thermal-magnetic trip functions of the poles 29 and 31, the circuit breaker 1 includes an electronic trip device 33 which can provide ground fault and/or arc-fault protection. As described in U.S. Pat. No. 5,483,211, the electronic trip device 33 is housed in the third compartment 27 and includes a solenoid, which in response to ground fault or arcing conditions detected in either pole actuates a finger 105 extending through and opening 107 in the partition 23 into the first compartment 21 where it bears against the magnetic armature 77 to trip the first pole mechanism 29 in a manner described above for a magnetic trip. As also described above, tripping of the first pole 29 results in tripping of the second pole 31 by the coupler 35.

Figure 4:
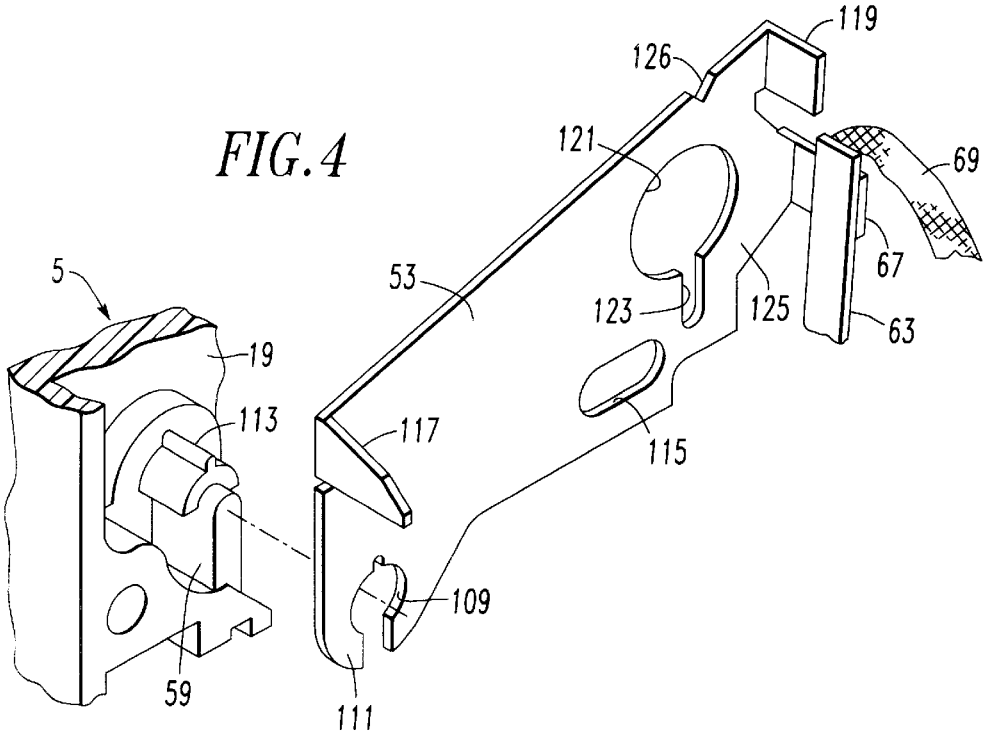
FIG. 4 is an isometric view of a support plate and its mount which form part of the circuit breaker.

Calibration of the poles 29 and 31 of the circuit breaker 1 is effected through adjustment of the metal support frame 53 of the associated pole. This metal support frame 53 for the pole 29 is shown in more detail in FIGS. 4 and 5. The support plate 53 has opening 109 in a lobe 111 at one end which is keyed to and engaged by a projection 113 on the molded pivot 59 in the partition 19 of the top base 5. An oval shaped opening 115 spaced from the opening 109 engages a molded pin (not shown) on partition 19 (not shown). The openings 109 and 115 fit snugly over the corresponding projections to firmly fix the position of the metal support frame 53 within the top base 5. Bent over tabs 117 and 119 at the two upper ends of the metal support frame 53 butt against the top cover 7 of the housing to further maintain the fixed position of the metal support frame 53 when the circuit breaker 1 is assembled. A large aperture 121 near the right hand end of the metal support frame 53 accommodates the coupler 35.

The opening 121 and an intersecting calibration receptacle or slot 123 partially separate a free end 125 from the remainder of the support 53. A notch 126 in the top edge of the metal support frame 53 further weakens the connection of the free end 125 to the remainder of the support plate 53. The flange 67 to which the bimetal 63 is secured extends laterally from the free end portion 125 of the metal support frame 53.

Figure 5:
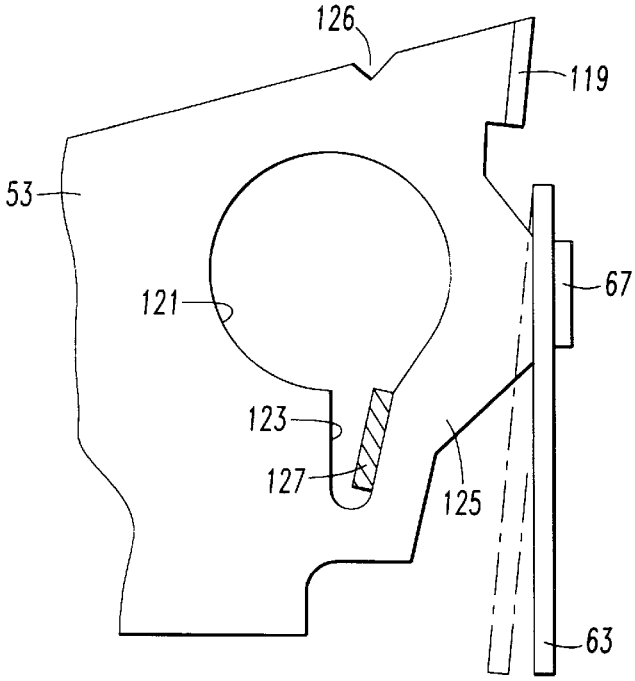
FIG. 5 is a fragmentary view of a portion of the support plate of FIG. 4 illustrating a calibration adjustment made in accordance with the invention.

Heretofore, the circuit breaker 1 has been calibrated by assembling the pole mechanism 29 within the cavity of the top base 5, and before the top cover 7 is installed, applying the calibrating current between the terminals 45 and 75 with this pole mechanism closed. With the pole mechanism in this "on the half shell" condition, a tool 127 is inserted into the calibration receptacle or slot 123 as represented in FIG. 5. When the prescribed time of application of the calibrating overcurrent has elapsed, the tool 127 is rotated to distort the free end 125 of the metal support frame 53 thereby rotating flange 67 carrying the bimetal 63 and forcing the breaker to trip. As seen in FIG. 5, the distortion of the metal support frame 53 causes the bimetal 63 to rotate from the phantom position to the full-line position. This calibration is performed automatically by a machine which applies current to the terminals, inserts the tool 127 into the slot 123, and rotates the tool 127 to force the breaker to trip upon expiration of the prescribed time. Once the circuit breaker 1 has been calibrated, the top cover 7 is placed over the top base 5 to enclose the compartment 21 and is secured in place by the rivets 15. The second pole 31 is similarly calibrated "on the half shell" before the circuit breaker is fully assembled. The circuit breaker is then tested by again applying the calibrating current and observing the breaker trips at the prescribed time within specified tolerances. If the circuit breaker 1 does not pass the test, a hook is inserted into an opening 129 molded in the housing top base 05 to engage the free end of the bimetal 63 and either push or pull the bimetal in an attempt to bring the thermal trip within the calibration limits. This repair is performed manually and is difficult to implement. While this repair procedure has increased the number of circuit breakers within calibration tolerance, it is time consuming and difficult to implement.

U.S. Pat. No. 5,008,645 teaches an arrangement and procedure for calibrating a single pole circuit breaker after it has been fully assembled. An opening molded into the housing wall and aligned with the calibration slot in the metal support frame allows the calibration tool to be inserted and rotated to adjust the bimetal calibration with the circuit breaker fully assembled. While this arrangement and method is suitable for calibrating the second pole mechanism 31 of the two-pole circuit breaker 1 where the metal support frame is adjacent to the outer wall of the bottom base 11, it is not suitable for calibrating the pole mechanism 29 of the two-pole breaker such as that shown number in U.S. Pat. No. 5,483,211, because the actuating member 95 for this pole is between the outside wall formed by the top cover 7 and the metal support plate and blocks access to the slot 123.

In accordance with the invention, the actuating member 95, is configured so that the actuating finger 97 extends adjacent to, but is laterally displaced from, a direct line 131 from a calibration hole 133 in the top cover 7 to the calibration receptacle slot 123, to permit insertion of the calibration tool 127 through the calibration hole 133 for engagement with the calibration slot 123 with a circuit breaker fully assembled. As can best be seen in FIGS. 6 through 8, this is accomplished by offsetting the actuating finger 97 from alignment with the center of the attachment member. More particularly, the actuating finger 97 is cantilevered from a hub 135 on the attachment actuating member 95 with the outer surface 137 of the actuating finger substantially tangent to the hub. The inner surface 139 of the actuating finger has an arcuate interface 141 with the hub 135. Furthermore, the actuating finger 97 is tapered toward the free end 143 so that the stress is more evenly distributed along the actuating finger. In addition, the nose 99 is configured to form with the actuating finger 97 a gap 145 which is aligned with the path 131 for inserting of the calibration tool. The gap 145 is sized so that even with rotation of the actuating member 95 during tripping of the circuit breaker, the direct line 131 between the calibration opening 133 and the calibration slot 123 remains unobstructed by the attachment member. While the attachment member 952 for the second pole 31 need not be similarly configured because it is not between the calibration opening in the housing and the calibration slot of the metal support frame of the second pole frame mechanism 31, it is preferred that a single actuating member configuration be established for both ends of the coupler to simplify assembly and reduce costs. Accordingly, the attachment member 95 has sockets 147 molded in each side face for engagement with the coupling rod 89 depending upon which pole the particular attachment member is used. As taught in U.S. Pat. No. 5,008,645 a tamper indicating seal 149 can be installed over the calibration opening 133 after the circuit breaker has been calibrated at the factory to preclude subsequent changing of the calibration.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising;

two pole mechanisms each including a bimetal and a metal frame on which the bimetal is carried, the metal frame having a calibration receptacle in which a calibration tool is inserted to calibrate the bimetal;

a molded housing having side-by-side compartments including two outer compartments each housing one of the pole mechanisms, the molded housing having calibration holes in outer walls of the two outer compartments aligned with the calibration receptacles;

a coupler coupling the two pole mechanisms and comprising:

a coupling rod extending between the outer compartments adjacent to the calibration receptacles;

actuating members on opposite ends of the coupling rod for engaging the pole mechanisms and simultaneously opening both pole mechanisms, one of the actuating members associated with one of the pole mechanisms having an actuating finger extending adjacent to but laterally displaced from a direct line from the calibration hole associated with the associated pole mechanism to the calibration receptacle of the associated pole mechanism to permit insertion of the calibration tool into the associated calibration receptacle with the circuit breaker fully assembled;

wherein the one actuating member further includes a hub mounted on the rod and from which the finger is cantilevered, and a nose extending from the hub and which is engaged by the associated pole mechanism to rotate the coupler, the nose and finger of the one actuating member forming a gap sized to avoid blocking of a direct line from the associated calibration hole in the molded housing to the associated calibration receptacle even with rotation of the coupler by a pole mechanism;

wherein each of the pole mechanisms has a trip device which includes the bimetal and a magnetic armature either of which when actuated trips the associated pole mechanism open, the actuating finger having a free end engaging the magnetic armature to actuate the trip device, the finger being tapered toward the free end; and wherein the actuating finger has a side facing the magnetic armature which is tangent to the hub and an opposite side having an arcuate interface with the hub.

2. The circuit breaker of claim 1 wherein the metal frame has a fixed portion secured in the housing and a free section to which the bimetal is secured, the calibration receptacle being a slot at an interface between the fixed portion and the freesection of the metal frame in which the calibration tool is manipulated to bend the free section relative to the fixed portion to calibrate the bimetal.

* * * * *